US007325690B2

(12) United States Patent
Cognard

(10) Patent No.: US 7,325,690 B2
(45) Date of Patent: Feb. 5, 2008

(54) DEVICE WHICH IS USED TO TRANSPORT A CONTAINER IN THE VERTICAL POSITION, COMPRISING PACKAGING CONTAINING A GYROSCOPIC SYSTEM

(76) Inventor: Eric Cognard, 7 Impasse Du Moulin, Damigny (FR) F-61250

( * ) Notice: Subject to any disclaimer, the term of this patent is extended or adjusted under 35 U.S.C. 154(b) by 446 days.

(21) Appl. No.: 10/532,306

(22) PCT Filed: Oct. 20, 2003

(86) PCT No.: PCT/FR03/50096

§ 371 (c)(1),
(2), (4) Date: Apr. 22, 2005

(87) PCT Pub. No.: WO2004/037653

PCT Pub. Date: May 6, 2004

(65) Prior Publication Data

US 2006/0102514 A1 May 18, 2006

(30) Foreign Application Priority Data

Oct. 22, 2002 (FR) ..... 02 13161
Oct. 17, 2003 (FR) ..... 03 50699

(51) Int. Cl.
*B65D 81/05* (2006.01)

(52) U.S. Cl. ..... 206/583

(58) Field of Classification Search ..... 206/0.6, 206/569, 521, 583
See application file for complete search history.

(56) References Cited

U.S. PATENT DOCUMENTS 3,656,649 A 4/1972 Martin
4,919,300 A 4/1990 Anderson et al.
5,232,095 A * 8/1993 Childers et al. ..... 206/583
6,490,880 B1 * 12/2002 Walsh ..... 62/457.9
6,901,971 B2 * 6/2005 Speasl et al. ..... 141/1
2003/0155271 A1 * 8/2003 Menceles ..... 206/583

FOREIGN PATENT DOCUMENTS

| | | |
|---|---|---|
| DE | 946 274 | 7/1956 |
| DE | 950 058 | 10/1956 |
| FR | 2 170 | 1/1904 |
| FR | 585 827 | 3/1925 |

* cited by examiner

*Primary Examiner*—Jacob K. Ackun, Jr.
(74) *Attorney, Agent, or Firm*—Young & Thompson

(57) ABSTRACT

The invention relates to a device (10) for transporting a receptacle (16) comprising packaging (12) of polyhedral shape inside which there is arranged a gyroscopic system (14) intended to keep the receptacle (16) upright, of the type in which the gyroscopic system (14) comprises an inner first frame (32) which bears the receptacle (16) and an outer second frame (34), the inner first frame (32) being mounted so that it can rotate with respect to the outer second frame (34) about a first axis of articulation (A1) and the second frame (34) being mounted so that it can rotate with respect to the polyhedral packaging (12) about a second axis of articulation (A2) orthogonal to the first axis (A1), characterized in that the second axis of articulation (A2) extends more or less along one of the diagonals of the polyhedral packaging (12).

20 Claims, 6 Drawing Sheets

DEVICE WHICH IS USED TO TRANSPORT A CONTAINER IN THE VERTICAL POSITION, COMPRISING PACKAGING CONTAINING A GYROSCOPIC SYSTEM

The present invention relates to a device for transporting a receptacle in a vertical position, comprising packaging inside which a gyroscopic system is arranged.

The invention applies in particular to the field of the transportation and/or storage of goods, more particularly to the transportation of liquid or solid products that have to be kept upright while they are being transported.

The products to which the invention relates are, in particular, although not exclusively, biological products kept at a very low temperature using a cryogenic fluid such as liquid nitrogen.

In the field of receptacles for transporting liquefied gases there are two main techniques that are known, namely, on the one hand, hermetically sealed receptacles equipped with a system for controlling the internal pressure and, on the other hand, unsealed receptacles to which the invention more particularly relates.

These unsealed receptacles are used for transporting, under atmospheric pressure, gases of high density, these receptacles being designed to allow the free escape of the vapours they contain or that they produce as they gradually warm up.

For example, nitrogen may be transported in thermally insulated receptacles not fitted with any device for sealing them. However, the transport receptacle or container absolutely must then be kept upright so as to prevent accidental spillage of the liquid nitrogen.

Because of its simplicity, this type of receptacle is very widely used particularly for transporting or even storing biological material that needs to be kept at a very low temperature.

Now, most of these known containers or packagings are made of metal and are manufactured from materials whose high cost makes any single-use application prohibitive.

In addition, for transporting biological material, the commercial value of which may be very low, the despatch expenses generated by the use of such containers are very high.

On the one hand, the weight of the metal containers contributes to an increase in the cost of transportation and, on the other hand, the return of the empty container to the original despatch site needs to be organized if the cost in returning it is lower than the purchase price of a new unit.

This system of returning items imposes a considerable constraint particularly in the case of long-distance deliveries or when the dispatcher is confronted with high peak seasonal demands governed by biological laws that cannot easily be circumvented. This is particularly the case with the reproduction of certain animal species from frozen gametes or embryos.

Furthermore, when transportation is placed in the hands of a courier service, the containers are vulnerable and remain exposed to frequent knocking-over and knocks, especially in the case of the less stable small units. Now, complete or partial loss of the cooling liquid correspondingly reduces the shelf-life of the goods, or even causes their irreparable destruction.

The prior art discloses various solutions which been proposed in order to alleviate these drawbacks and which in particular employ gyroscopic systems.

In these solutions, the packagings are provided with a gyroscopic system, that it is to say with an internal mechanism that allows the transport receptacle to rotate freely about two orthogonal axes so that, under the effect of its own weight, the receptacle constantly remains in an upright position irrespective of the orientation of the packaging.

Document FR-A-332 713 describes, for example, a device for transporting biological products, more particularly living yeasts in their liquid nutrients, comprising such a gyroscopic system.

More specifically, the gyroscopic system is secured to cubic transport packaging and comprises an outer first hoop which is mounted so that it can rotate, with respect to the packaging, about an axis of articulation by means of two trunnions supported by two opposite faces of the packaging and an inner second hoop which is mounted so that it can rotate, about another axis of rotation, inside the first hoop by means of two more trunnions supported by the first hoop and arranged in a direction perpendicular to that of the trunnions belonging to the packaging.

Thus, the two axes of articulation of the hoops of the gyroscopic system are mutually orthogonal and are perpendicular to the faces of the packaging.

Such devices require first of all time to build and assemble them, particularly to mount the first hoop of the gyroscopic system that is secured to the walls of the packaging, which means that such packagings are, by their design, relatively complicated, lengthy and expensive to produce.

Next, they have another disadvantage associated with their return, namely that this proves very expensive because of their weight and their volume when empty because, as the gyroscopic system is secured to the packaging, it has to be returned therewith.

This disadvantage associated with the volume also appears when the packagings are not being used, requiring a great deal of storage space.

Finally, and above all, the central receptacle transported using such packagings proves to be very sensitive to knocks, particularly knocks transmitted during transport and/or handling operations, because such knocks sustained by the packaging are transmitted directly to the gyroscopic system secured to the walls of the packaging.

There is thus a significant risk of damage, mainly to the structure of the gyroscopic system and/or to the receptacle it supports, and therefore to the transported product.

Finally, such packaging has to be rigid enough for the walls to be able in particular to support the weight of the gyroscopic system and of the transport receptacle.

The invention proposes a device for transporting a receptacle that makes it possible to remedy the disadvantages of the prior art.

To this end, the invention proposes a device for transporting a receptacle comprising packaging of polyhedral shape inside which there is arranged a gyroscopic system intended to keep the receptacle upright, of the type in which the gyroscopic system comprises an inner first frame which bears the receptacle and an outer second frame, the inner first frame being mounted so that it can rotate with respect to the outer second frame about a first axis of articulation and the second frame being mounted so that it can rotate with respect to the polyhedral packaging about a second axis of articulation orthogonal to the first axis, characterized in that the second axis of articulation extends more or less along one of the diagonals of the polyhedral packaging.

By virtue of the invention, the transport device has a structure that it is less sensitive to knocks than the packagings according to the prior art. For preference, the device comprises shock-absorbing means arranged between the packaging and the gyroscopic system.

Advantageously, the gyroscopic system according to the invention is simpler and quicker to set up in the packaging and can be manufactured with materials that are sufficiently inexpensive that there is no need to encourage their return and that the transport device can be a single-use, that is to say disposable, item.

In addition, the device according to the invention is simple in design and easy to operate, particularly since the gyroscopic system can be introduced into and held in the packaging, of which it is independent, simply and quickly and without using any tools.

The time spent preparing the packaging prior to its dispatch is therefore appreciably shorter than in the solutions of the prior art.

Furthermore, the transport device according to the invention can be stored in the dismantled position, generally flat overall, so that it takes up considerably less space.

According to other features of the invention:

the outer second frame is a flat ring and in that the second axis of articulation is situated in the plane of this ring, the outer second frame is a ring more or less in the shape of an ellipse and in that the second axis of articulation is more or less coincident with the major axis of the ellipse, the first axis of articulation (A1) is more or less coincident with the minor axis of the ellipse, the inner first frame is a flat ring of circular shape and in that the first axis of articulation is situated in the plane of this circular ring, the device comprises supporting means supporting the gyroscopic system, on which the outer second frame is mounted so that it can rotate about the said second axis of articulation, the supporting means comprise a flat supporting surround comprising two opposed parallel mounting members housed in two inside corners of the polyhedral packaging which corners are opposed along the said diagonal, the supporting surround comprises two parallel and opposed branches which support articulation means for articulating the outer second frame with respect to the supporting surround and which make an acute angle with respect to the said mounting members, the supporting means consist of two opposed components each of which is arranged inside one of the said two vertices of the polyhedral packaging which are opposed along the said diagonal, and each of which supports articulating means articulating the outer second frame about the said second axis of articulation, each supporting intermediate component comprises a base which runs in a plane perpendicular to the said diagonal and supports, on the one hand, the articulating means and, on the other hand, three positioning arms arranged as a trihedron and each of which runs along one of the three edges associated with the said vertex of the packaging, the base of the intermediate component is of triangular shape and in that each positioning arm runs from one of the vertices of the triangular base, the articulating means articulating the outer second frame consist of a trunnion secured to the outer second frame and which is housed in a complementary housing in the base of the intermediate component, the trunnion of the outer second frame is assembled with the base of the intermediate component as an elastic push-fit, shock-absorbing means are inserted between the supporting means and the polyhedral packaging, particularly in the corresponding interior corners of the packaging, the shock-absorbing means is a cylindrical sleeve, made of an elastically deformable material, one end of which accommodates the positioning arm and the other end of which rests against an opposite face of the polyhedral packaging, the receptacle and the inner first frame of the gyroscopic system comprise complementary means so as to allow the receptacle to be introduced in an insertion travel perpendicular to the plane of the inner first frame, then allow the receptacle to be locked in the inner first frame at the end of the insertion travel, the locking of the receptacle in the inner first frame is obtained, after insertion, by rotational movement so as to engage one or more cones in complementary slots in a bayonet-type mounting, the locking of the receptacle in the inner first frame is obtained, after insertion, by elastic deformation of the inner first frame so that the said inner frame automatically positions itself in a complementary locking groove belonging to the receptacle, the transport receptacle is a cryostat, the polyhedral packaging is a box of parallelepipedal, particularly cubic, shape, comprising an open upper face for filling the box.

Other features and advantages of the invention will become apparent from reading the detailed description which follows, for an understanding of which reference will be made to the attached drawings, given by way of nonlimiting examples, and in which.

In the description which will follow, identical or similar reference numerals denote components which are identical or have similar functions.

Figure 1:
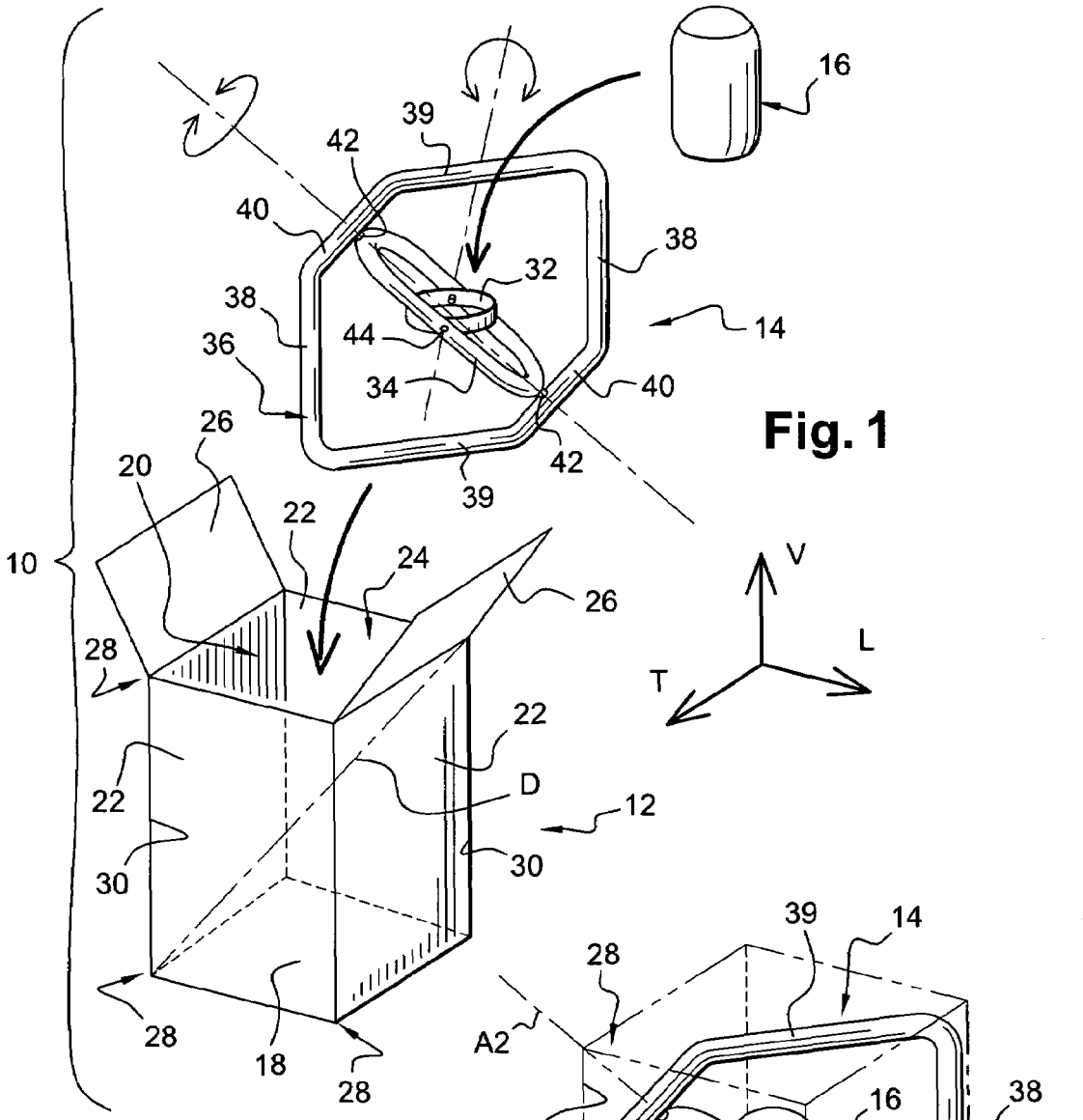
FIG. 1 is an exploded perspective view of a transport device according to the invention depicting the main components of the device before they are assembled and fitted and which illustrates a first embodiment of the supporting means supporting the gyroscopic system according to the invention.

By convention, the terms "interior", "exterior" respectively denote elements close to the receptacle and close to the packaging and the directions "horizontal", "vertical" and "transverse" are given with respect to the trihedron (L, V, T) in FIG. 1.

FIG. 1 depicts a transport device 10 comprising, vertically from the bottom upwards, a packaging or box of polyhedral shape 12 which is able to house a gyroscopic system 14 intended to keep a receptacle 16 upright.

The polyhedral packaging 12 is preferably of parallelepipedal, particularly of cubic, shape.

The polyhedral packaging 12 comprises a lower horizontal face 18, an upper horizontal face for filling 20, and four vertical faces 22, each of the lateral faces 22 being orthogonal to the faces adjacent to it and parallel to one opposite lateral face.

The packaging 12 thus delimits an internal volume 24 which is delimited at the bottom by the lower face 18 that forms a bottom, delimited laterally by the four vertical faces 22, and delimited at the top by the upper face 20 which is open to allow the packaging 12 to be filled.

In the known way, the upper face 20 can be closed once the volume 24 has been filled, by folding the two flaps 26 inwards or, alternatively, using a removable lid, not depicted.

The packaging or box 12 has eight vertices 28 each defined by the intersection of three faces of the parallelepiped.

The packaging also comprises four internal corners 30 each of which is delimited by the intersection of two consecutive lateral faces 22.

In such packaging 12, a diagonal D is, by definition, a straight line joining two vertices 28 which do not belong to one same face of the parallelepiped.

The packaging thus has four vertical diagonals, one of which is illustrated in FIG. 1.

The packaging 12 illustrated in FIG. 1 is a cube forming a box, which is preferably made of cardboard, but which could just as well be made from other materials and in other polyhedral shapes, for example rectangular parallelepiped or on a "hexagonal" base 18.

Figure 3:
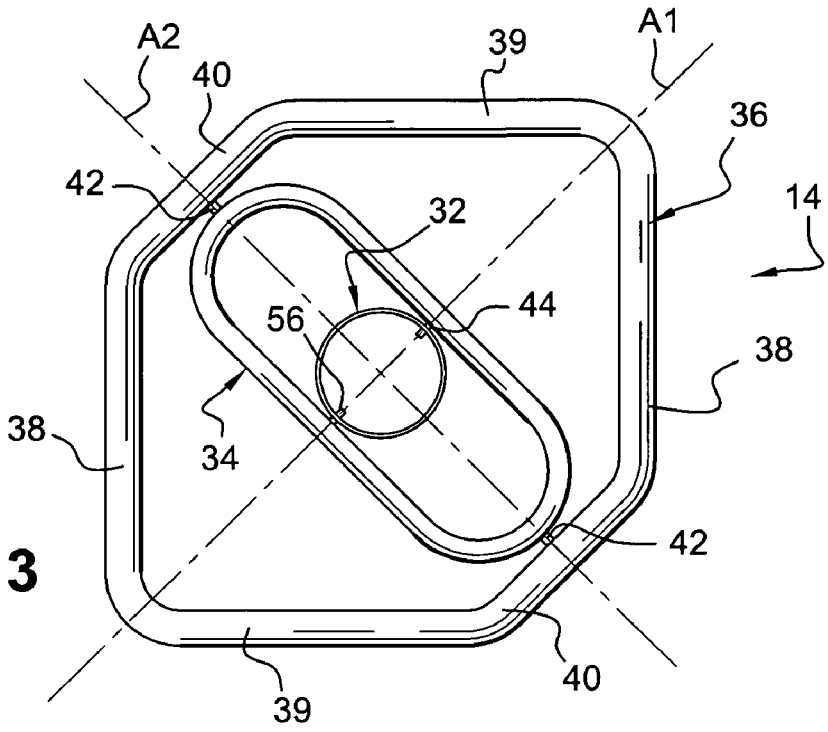
FIG. 3 illustrates a view of above of the gyroscopic system and its supporting surround in the folded storage position.

FIGS. 1 and 3 respectively depict the gyroscopic system 14 in the position of use and in the storage position, that is to say advantageously flat.

As can be seen in these figures, the gyroscopic system 14 comprises an inner first frame 32 able to support the receptacle 16 and an outer second frame 34.

The inner first frame 32 is mounted so that it can rotate with respect to the outer second frame 34 about a first axis of articulation A1, and the outer second frame 34 is mounted so that it can rotate with respect to the packaging 12 about a second axis of articulation A2 orthogonal to the first axis of articulation A1.

The two axes A1 and A2 here are perpendicular and concurrent.

The outer second frame 34 is a flat ring and the second axis of articulation A2 is situated in the plane of this ring 34.

More specifically, the outer second frame 34 is a ring more or less in the shape of an ellipse, the major axis of which is more or less coincident with the second axis of articulation A2.

The inner first ring 32 is a flat ring of circular shape and the first axis of articulation A1 is situated in the plane of this ring 32.

In addition, the first axis of articulation A1 is more or less coincident with the minor axis of the ellipse forming the outer second frame 34.

The transport device 10 comprises supporting means supporting the gyroscopic system 14, particularly for wedging the gyroscopic system 14 in the packaging 12.

According to a first embodiment illustrated in FIGS. 1 and 3, the supporting means supporting the gyroscopic system 14 consist of a surround 36 on which the outer elliptical frame 34 is mounted able to rotate about the said second axis of articulation A2.

The supporting surround 36 is a flat surround and consists of tubular sections made, for preference, by moulding a plastic in a single piece like the frames 32 and 34.

The supporting surround 36 comprises two parallel and opposed vertical 38 and horizontal 39 members which overall form a rectangle two of the diagonally opposed corners of which are "truncated" by two parallel and opposed branches 40 that form an acute angle with respect to the members 38, 40, in this instance the angle being more or less equal to 45°.

Figure 2:
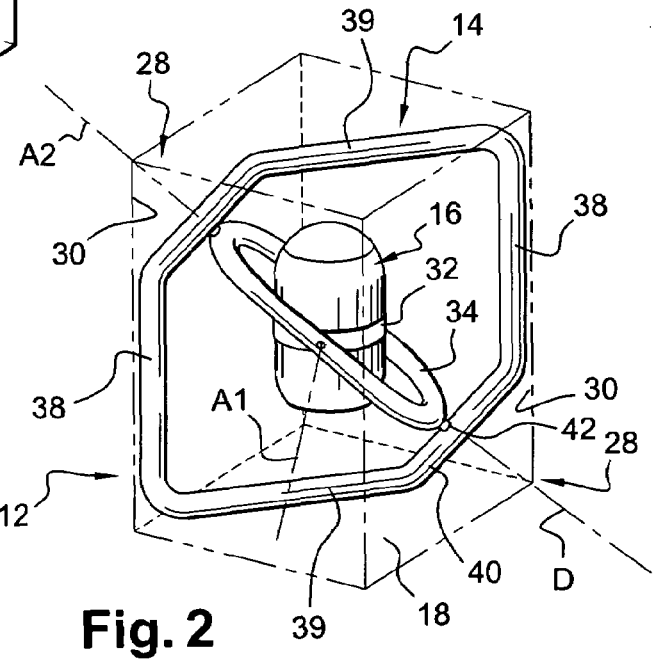
FIG. 2 is a view similar to that of FIG. 1 illustrating all the components when the device is in its fitted and assembled position ready for transport and in which the packaging box is depicted in outline.

The branches 40 support articulating means 42 for articulating the elliptical frame 34 with respect to the supporting surround 36 which, as can be seen in FIG. 2, is fixed with respect to the packaging 12.

The articulating means 42 for articulating the elliptical frame 34 about the axis A2 with respect to the surround 36 consist for example of trunnions or any other appropriate means.

Likewise, known means 44 of articulating the inner circular ring 32 with respect to the outer elliptical frame 34 about the axis A1 are provided.

In a known way, the gyroscopic system 14 is intended to keep the receptacle 16 upright, particularly during transport and/or handling operations during which the packaging 12 may for example be turned over into any orientation or experience knocks.

The receptacle 16 is advantageously a cryostat, that is to say a thermally insulated receptacle able to keep liquid or solid products, for example biological products, at a low temperature for a determined length of time by virtue of a cryogenic fluid such as liquid nitrogen.

The receptacle 16 in this instance comprises an outer body 46 which is preferably made of a thermally insulating material such as polystyrene or polyurethane and which centrally comprises a housing open at the top and closed off by a plug 48.

The housing (not depicted) of the outer body 46 of the receptacle 16 is able, for example, to accommodate an insulating internal flask (not depicted) of the type comprising a double glass wall separated by a vacuum so as to keep the biological products it contains at a given temperature for a determined length of time, such a flask being known commercially by the name of a "thermos" flask (registered trademark).

In a horizontal plane of section, the outer cylindrical body 46 of the receptacle 16 is of overall circular cross section.

The body 46 comprises a lower part 50 of diameter D1 roughly equal to the diameter of the circular ring 32 and which connects to an upper part 52 of diameter D2 greater than the diameter D1, via a downward-facing shoulder 54 for positioning the circular ring 32 along the external wall of the receptacle 16.

Advantageously, the receptacle 16 and the inner first frame 32 comprise complementary means to allow the receptacle 16 to be introduced with a "vertical" insertion travel perpendicular to the plane of the circular ring 32 then allow this receptacle to be locked in the circular ring 32 at the end of the insertion travel.

According to the first embodiment of the gyroscopic system 14 illustrated in FIG. 3, the receptacle 16 may easily be inserted vertically downwards into the circular ring 32 before the system 14 is made up into the transport configuration. Failing this, one of the branches 39 of the supporting surround 36 is liable to hamper the insertion operation.

Figure 4:
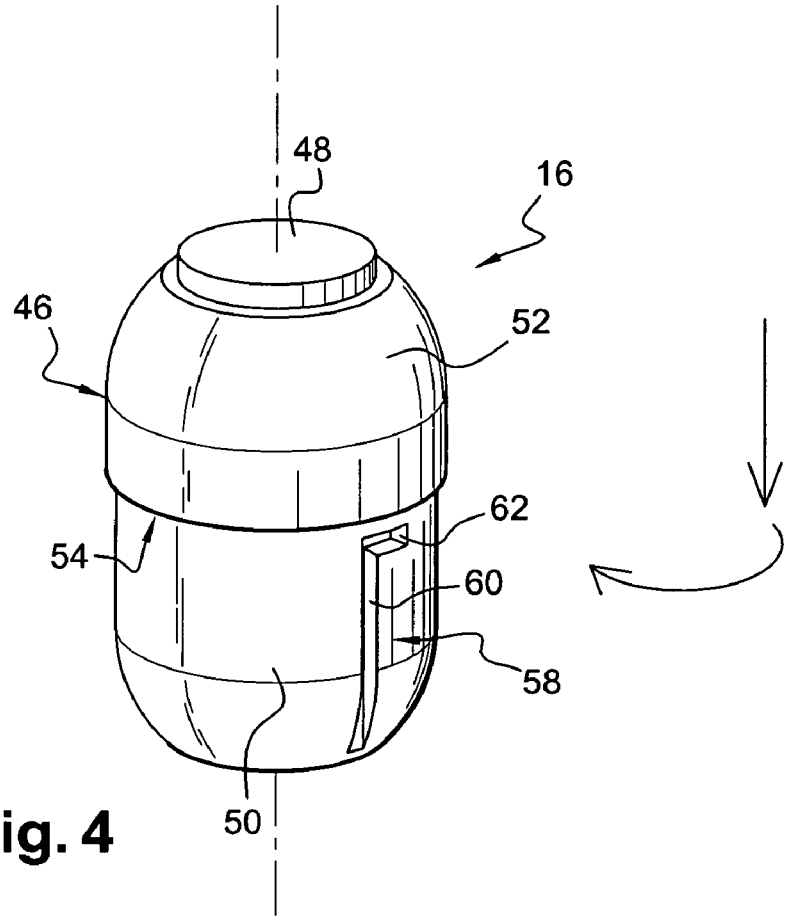
FIG. 4 is a perspective view of a first exemplary embodiment of the locking means for locking the container intended to be carried and kept upright by the gyroscopic system.

FIG. 4 more particularly illustrates a first exemplary embodiment of such a receptacle 16 comprising means that complement the circular ring 32 so that a mounting of the bayonet type can be achieved.

More specifically, the circular ring 32 comprises pins 56 which extend radially towards the inside of the ring 32 and the lower part 50 of the receptacle 16 comprises two slots 58 arranged symmetrically with respect to the central vertical axis and one of which is illustrated.

Each slot 58 comprises a first section 60, guide, which runs vertically and in a straight line and is extended, at its top end, by a second section 62 which is a horizontal locking section and forms a notch complementing the pins 56 of the circular ring 32.

Thus, with the pins 56 in register with the guide sections 60 of the slots 58, the receptacle 16 is inserted vertically downwards into the circular ring 32, then locking is obtained by turning the receptacle 16 to cause the pins 56 to enter the notches or locking sections 62.

Initial introduction of the receptacle 16 into the circular ring 32 is made easier by the chamfer-forming profile of the lower end of the lower part 50 of the receptacle 16.

FIG. 2 illustrates the transport device 10 in the transport configuration, that is to say the configuration in which the subassembly made up of the supporting surround 36 and the gyroscopic system 14 in which the receptacle 16 has been mounted, is placed inside the interior volume 24 of the polyhedral packaging 12 depicted in outline.

According to the invention, the second axis of articulation A2 of the gyroscopic system 16 runs more or less along the diagonal D of the packaging 12.

The gyroscopic system 14 may be arranged inside the interior volume 24 of the packaging 12 along any one of the four diagonals.

Thereafter, whatever the position in which the packaging is transported or stored, the axis A2 is always directed along a diagonal and the receptacle is in an upright position.

Thus, the supporting surround 36 is arranged inside the packaging 12 in such a way that the horizontal members 39 run parallel to the lower 18 and upper 20 faces, in such a way that the vertical members 38 are housed without play in two interior corners 30 of the packaging 12 that are opposed along the diagonal D so as to wedge the subassembly in the packaging 12.

It is particularly advantageous for the packaging 12 to be able to absorb some of the knocks and vibrations without these being transmitted to the gyroscopic system 14 by the supporting surround 36.

Advantageously, the supporting surround 36 does not extend into the two upper and lower vertices 28 that are opposed along the diagonal of the axis of articulation A2, which means that knocks in this direction are not transmitted, or are transmitted very little, to the subassembly formed by the surround 36 and the gyroscopic system 14.

As an alternative that has not been depicted, the supporting surround 36 comprises four corner branches 40 which means that the surround 36 has no part extending into one of the vertices 28 of the packaging 12.

Thus, if the packaging 12 is dropped for example, its corners corresponding to the vertices 28 can deform as the cardboard crumples, without, however, the shock waves being wholly and directly transmitted to the gyroscopic system 14 and/or to the receptacle 16.

The ability of the corners of the packaging 12 to deform is made possible by the arrangement whereby the branches 40 of the supporting surround 36 are set back towards the inside of the packaging 12 and through the choice of material used for the packaging 12.

By virtue of the invention, the receptacle 16 is better protected from knocks, particularly side impacts, that is to say knocks in the direction of one of the faces 22 of the packaging 12 than in the prior art in which one of the axes of articulation of the system was secured to the faces.

Indeed, no knocks on a lateral face are transmitted directly to the gyroscopic system on which no axis A1, A2 is orthogonal to any of the faces of the packaging 12.

As a preference, the supporting surround 36 is able to deform in order to absorb shocks and for example comprises recesses in its structure, such as in the horizontal members 39, in order to give it the capacity to experience elastic deformation, particularly in the vertical direction and, what is more, to reduce its weight.

Advantageously, the supporting surround 36 comprises additional shock-absorbing means which are inserted generally between the surround 36 and the packaging 12.

Such means are not illustrated for the first embodiment.

The supporting surround 36 may thus be equipped with shock-absorbing means such as split cylindrical sleeves made of foam which are mounted on the members of the surround 36 so that they are inserted between the surround 36 and the packaging 12 in the corners 30.

Figure 5:
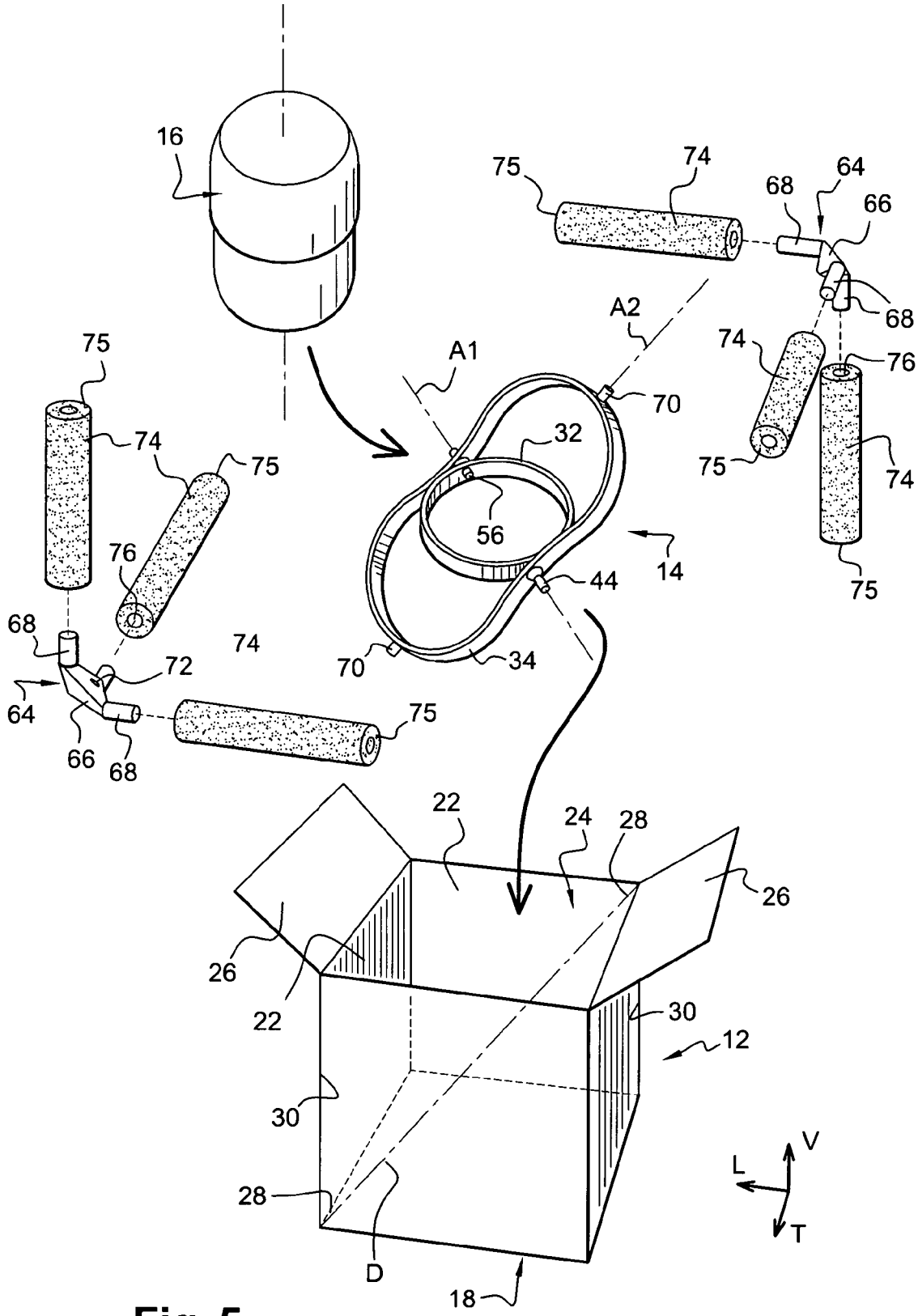
FIG. 5 is a perspective view similar to that of FIG. 1 illustrating a second embodiment of the supporting means and of the gyroscopic system according to the invention.
Figure 6:
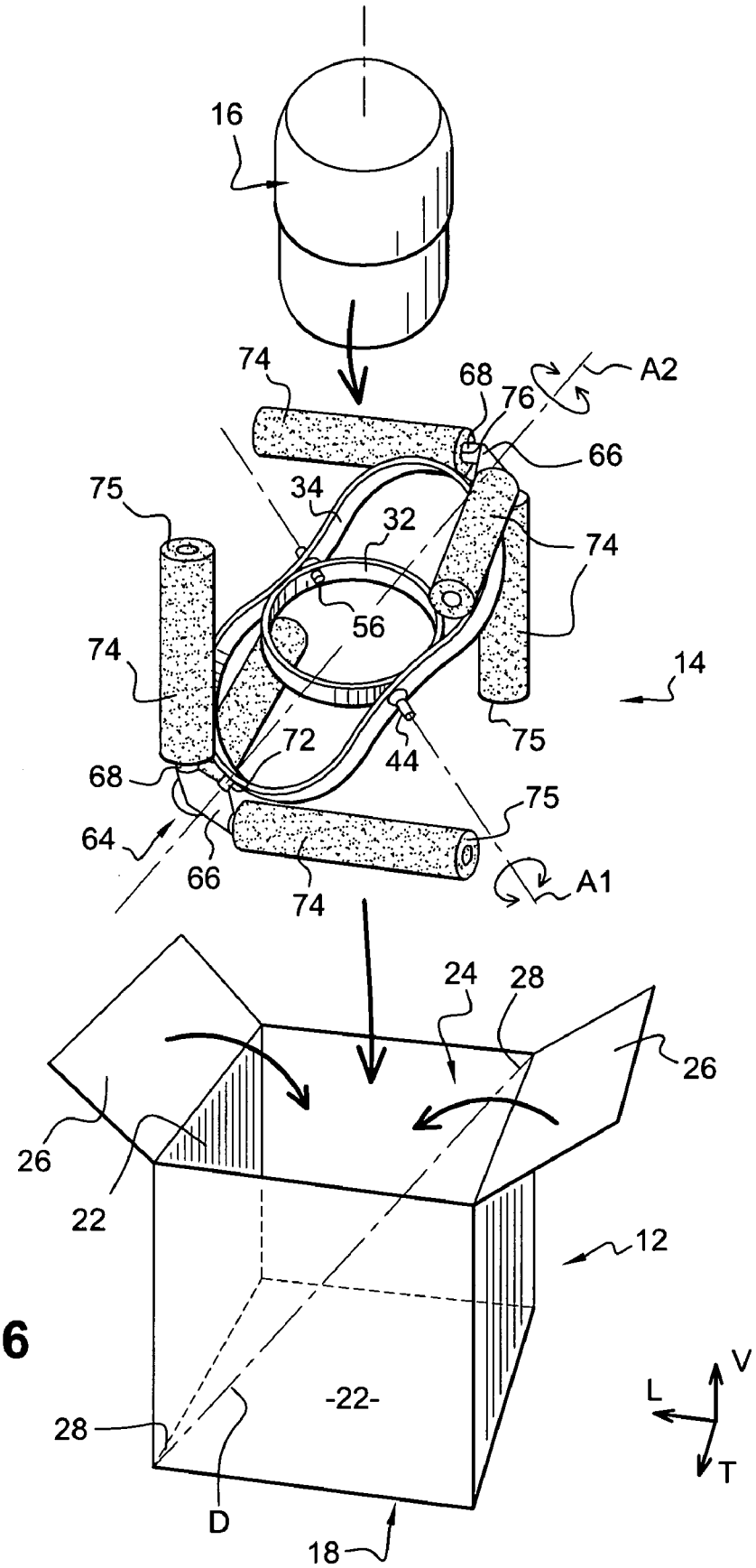
FIG. 6 is a perspective view of the transport device according to FIG. 5, depicting the gyroscopic system and its supporting means in the fitted and assembled position.
Figure 7:
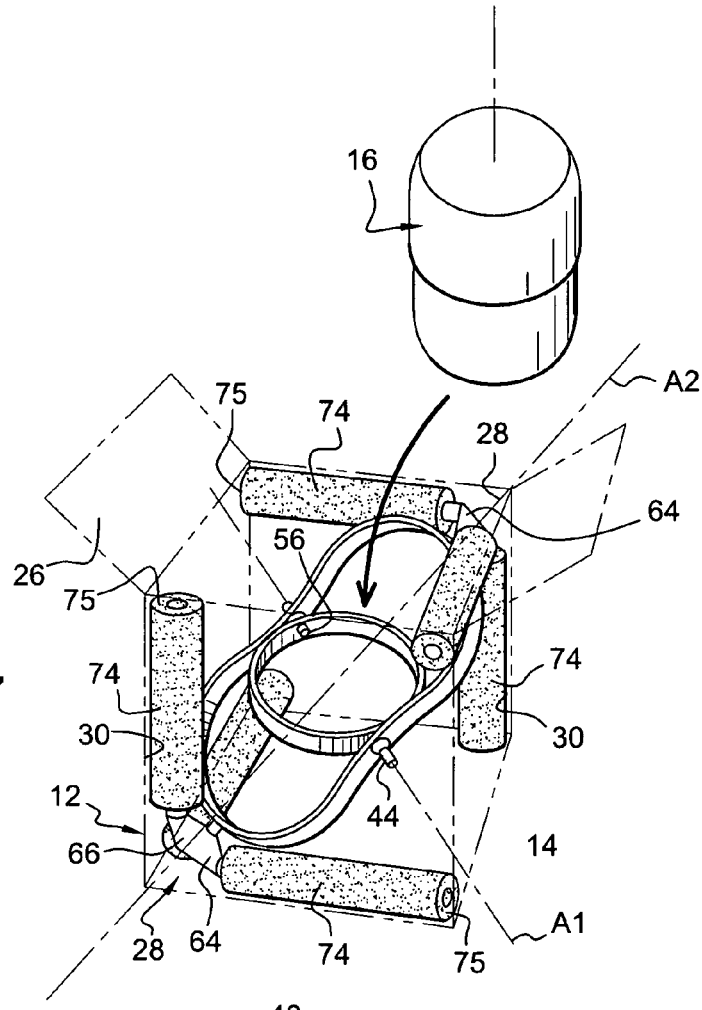
FIG. 7 is a perspective view of the transport device according to FIG. 6 in the transport configuration illustrating the gyroscopic system arranged inside the polyhedral packaging, before the receptacle is inserted.

FIGS. 5 to 7 depict a preferred second embodiment of the supporting means supporting the gyroscopic system 14 which will now be described by comparison and analogy with the first embodiment illustrated in FIGS. 1 to 3.

As can be seen in FIG. 5, the supporting means supporting the gyroscopic system 14 comprise two diagonally opposed identical components 64 each of which supports articulating means articulating the outer second frame 34 in the shape of an elliptical ring.

More specifically, each intermediate supporting component 64 comprises a body or base 66 of triangular overall shape which supports, on the one hand, the articulating means and, on the other hand, three positioning arms 68 arranged in a trihedron which each run from one of the vertices of the triangular base 66.

Thus, each arm 68 is designed to run in a direction parallel to the intersection of two faces of the packaging box 12.

The articulating means for articulating the elliptical ring 34 with respect to the supporting means, and therefore with respect to the packaging 12, about the axis of articulation A2 consist, for example, of a trunnion 70 secured to the outer second frame 34 and housed in a complementary housing 72 in the base 66 of the intermediate component 64.

Advantageously, the elliptical ring 34 is assembled with the base 66 of the intermediate component 64 by elastically push-fitting the trunnion 70 into the housing which means that assembly can be done simply and quickly.

The shock-absorbing means depicted consist of cylindrical sleeves 74 which are preferably made of foam or any other elastically deformable material.

The use of such cylindrical sleeves 74 is particularly advantageous in the case of a single-use disposable device. This is because they can be obtained very economically by cutting up a tubular section made of expanding foam.

Each cylindrical sleeve 74 has, at a first end, a bearing face 75 and, at least in the opposite face at its other end, a hole 76 intended to accommodate for example as a push fit, one of the positioning arms 68 of the supporting component 64.

FIG. 6 depicts, before it is arranged in the packaging 12, the subassembly consisting of the gyroscopic system 14 and the supporting means after each intermediate component 64 has been assembled with the elliptical ring 34 and the shock-absorbing cylindrical sleeves 74.

Advantageously, the receptacle 16 may be mounted by insertion into the circular ring 32 of the gyroscopic system 14 after the operation of arranging the subassembly in the packaging 12 so as to obtain the transport configuration illustrated in FIG. 7.

According to the invention, in this transport configuration, the second axis of articulation A2 of the gyroscopic system 14 runs more or less along one of the diagonals D of the packaging 12.

Each of the supporting intermediate components 64 is arranged inside one of the two vertices 28 of the packaging 12 which are opposed along the said diagonal D corresponding to the second axis of articulation A2.

As a preference, the base or mounting plate 66 of the component 64 runs in a plane perpendicular to the said diagonal and each of the positioning arms 68 and of the associated cylindrical sleeves 74 run along one of the three edges of the interior corners of the corresponding vertex 28.

The length of the sleeves 74 is such that their free end faces 75 bear against the lateral faces opposite, so as to wedge the component 64 in the box 12.

By virtue of the invention, the receptacle 16 is better protected against knocks, particularly side impacts, that is to say knocks to one of the faces 22 of the packaging 12.

The sleeves 74 constitute shock-absorbing means which are interposed between the supporting means formed by the components 64 and the packaging 12.

As a preference, the elliptical ring 34 is also elastically deformable so as to increase the capacity of the device to absorb knocks.

Figure 8:
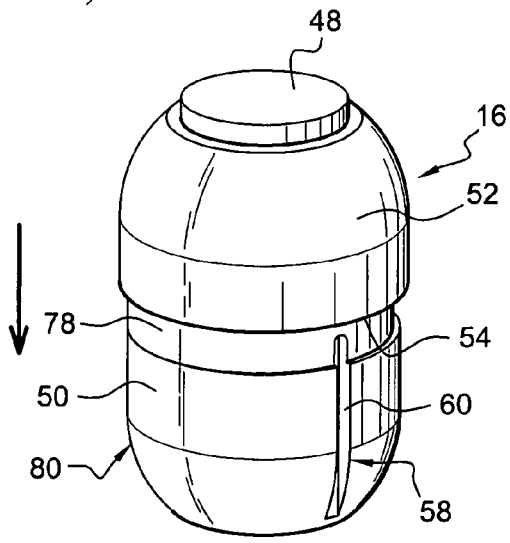
FIG. 8 is a perspective view of a second exemplary embodiment of the locking means for locking the receptacle intended to be supported and kept vertical by the gyroscopic system.

FIG. 8 depicts a second embodiment for inserting and locking the receptacle 16 forming a cryostat in the circular ring 32 of the gyroscopic system 14.

In this example, the locking of the receptacle 16 in the inner first frame 32 is obtained, after vertical insertion, by elastic deformation of the said first frame 32 so that the frame 32 formed by the circular ring automatically positions itself in a complementary locking groove 78 belonging to the receptacle 16.

The receptacle 16 and the circular ring 32 comprise similar complementary means, namely a radial pin 56 of the ring which enters the straight guide section 60 of a vertical slot 58 during the receptacle insertion travel in a downwards movement.

More specifically, the receptacle 16 comprises a cylindrical lower part 50 of which a control section 80 has, in section on a horizontal plane, a non-circular cross section, for example an oval one, the perimeter of which is more or less equal to the diameter of the circular ring 32 so as to cause elastic deformation of the said ring as the receptacle 16 is vertically inserted.

For a receptacle 16 produced in accordance with the first or second embodiment described hereinabove, tests have shown that, for determined particular conditions, there could be a non-zero risk of damage to the insulating flask.

These particular conditions correspond for example to the case of droppage during which the packaging 12 sustains an impact before the gyroscopic system 14 has been able to return the receptacle 16 to a more or less upright position so that the receptacle 16 is in a horizontal overall position at the time of the impact, that is to say a position that forms an acute angle with the central vertical axis.

With the receptacle 16 in such a position, if a shock wave is transmitted by the circular ring 32 to the outer body 46 of the receptacle 16, the forces exerted are then not distributed symmetrically over the entirety of the circumference of the circular ring 32, but are spread over only a portion thereof, unlike the scenario in which the receptacle 16 is in an upright position at the time of the impact.

As a result, there is a risk that, in the vicinity of the circular ring 32, a shock wave could, by propagating through the polystyrene outer body 46, be transmitted to the flask, particularly to the vertical walls that form the cylindrical body of the flask.

Now, in such an insulated flask, the glass double-walled cylindrical section is more sensitive to knocks than are the top or bottom of the flask which, because it is manufactured by blow-moulding, are somewhat thicker.

As a result, when the circular ring 32 is positioned on the outer body 46 vertically on the section of the cylindrical body formed by the lateral walls of the flask, the risk of knocks being transmitted to the weakest region of the insulating flask is increased, under these determined conditions.

In order to improve the protection of the flask it is possible, according to an embodiment that has not been depicted, to anticipate inserting, between the internal wall of the receptacle 16 delimiting the housing and the insulating flask, means for absorbing a shock wave and/or limiting its transmission to the insulating flask.

Advantageously, it is possible for example to inject into the receptacle 16 a polyurethane foam in order to fill the space between the flask and the interior wall of the outer body 46.

Once cured, the polyurethane foam forms a layer of material able to absorb all or some of the shock waves. In addition, the polyurethane foam allows the insulating flask to be immobilized and wedged in the housing, such a flask obtained by blow-moulding having no flat bottom on which it can be stood vertically in the housing.

It is thus possible to overcome the constraints of precision on the tolerances of the respective dimensions of the insulating flask and of the complementary housing in the receptacle 16, that is to say of two components made using the materials and manufacturing methods for which such precision is difficult to achieve.

Figure 9:
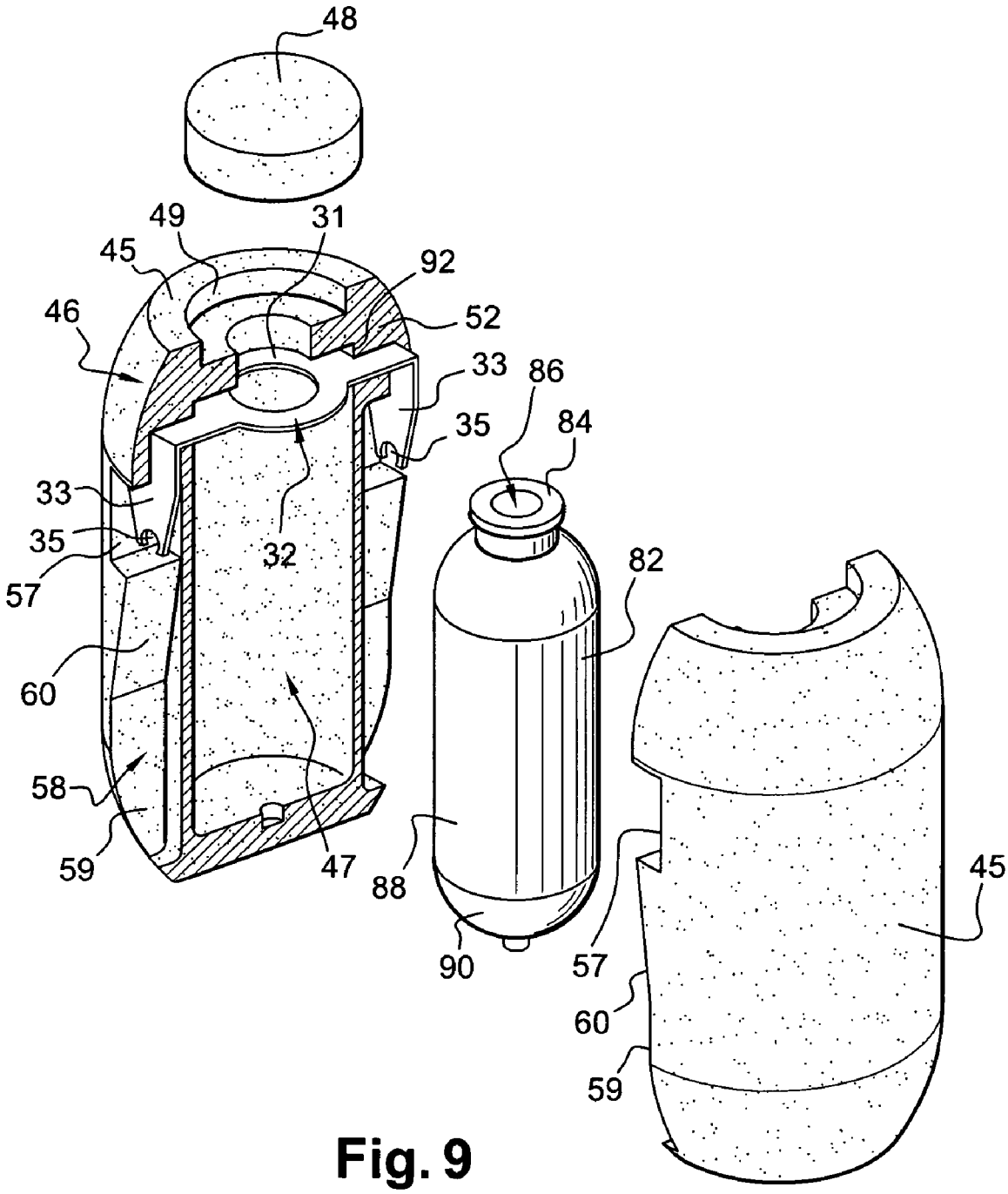
FIG. 9 is an exploded perspective view of a third exemplary embodiment of the receptacle intended to be supported and kept upright by the gyroscopic system.

FIG. 9 gives a detailed illustration of a third exemplary embodiment in which the inner frame 32, previously consisting of the circular ring, is incorporated into the receptacle 16 so as to improve the shock absorption and the protection of the insulating internal flask.

The receptacle 16 comprises an outer body 46 which is cylindrical overall and formed of two hollow half-shells 45 which, after assembly, internally delimit a housing 47 in which an insulating internal flask 82 is housed.

The two half-shells 45 are preferably made by moulding polystyrene and have symmetry about a vertical plane containing the central vertical axis of the receptacle.

The receptacle 16 is closed, but not sealed, by a plug 48 which is housed in a recess 49 of complementary shape that the outer body 46 has in its horizontal upper face.

The body 46 comprises, symmetrically on each of the vertical edges of the shells 45, complementary profiles which, when the half-shells 45 have been assembled, form the vertical slot 58.

As before, the receptacle 16 is intended to be introduced vertically upwards, in this case into the elliptical ring 34 to which the receptacle 16 is then fixed, for example by clipping-in or as an elastic push fit.

The inner frame 32 comprises a horizontal upper part 31 which is housed in a complementary recess 92 that the upper part 52 of the body 46 of each half-shell 45 has on its inside, and comprises two diametrically opposed vertical arms 33 secured to each of the ends of the part 31 of the frame 32.

The arms 33 run vertically downwards through the outer body 46 of the receptacle 16 on the outside of which they extend into the upper section 57 of the slot 58.

The arms 33 at their lower end comprise means 35 which complement the articulating means borne by the outer frame 34.

The means of articulation about the axis A1, that are borne by the outer frame 34, consist for example of trunnions (not depicted) running radially, in the manner of the pins 56, inside the elliptical ring 34 and onto which the complementary means 35 belonging to the arms 33 of the inner frame 32 are fitted.

The slot 58 advantageously comprises a straight lower section 59 which is widened to make the vertical insertion of the receptacle 16 into the elliptical ring 34 easier and which is extended by a guide section 60 of frustoconical shape that narrows towards the top in order to lead the means of articulation of the elliptical ring 34 into axial register with the complementary means 35 belonging to the arms 33, which are in the form of a ring open downwards.

Advantageously, the arms 33 have elasticity in the radial direction and can deform elastically in the upper section 57 of the slot 58 so as to filter out some of the shock wave.

The insulating flask 82 comprises here, vertically from top to bottom, a neck 84 delimiting an upper opening 86 to allow the biological products and cryogenic fluid to be introduced into the interior volume that is delimited laterally by an overall cylindrical body 88 formed by a glass double wall separated by a vacuum and which is closed by a bottom 90.

The horizontal part 31 of the frame is holed in the middle to allow the head 84 of the flask 82 to pass through with radial clearance.

The inner frame 32 is therefore advantageously secured to the upper part of the outer body 46 of the receptacle 16 in such a way as to prevent, in particular, a shock wave from being transmitted to the lateral walls of the insulating flask.

The axis A1 of articulation of the inner frame 32 forming a subassembly with the receptacle 16 with respect to the elliptical outer frame 34 is arranged vertically at roughly the same height along the receptacle 16 body 46 as in the previous embodiments.

Of course, as has been described hereinabove, it is possible to inject polyurethane foam in order to form a shock-absorbing layer inserted between the insulating flask 82 and the housing 47 of the receptacle 16 and allowing the flask 82 to be wedged in the said housing 47.

Advantageously, the transport device 10 according to the first or second embodiment constitutes a disposable device with a low cost of manufacture allowing a single-use application.

In addition, in the storage configuration, the device 10 takes up a small amount of space, especially the gyroscopic system 14 which is then flat overall.

As an alternative, once the package 12 has been received, the transport device 10, particularly the gyroscopic system 14 contained within the packaging 12, could be dismantled and temporarily put away in the storage position prior to its low-cost return in batches containing several devices.

The arrangement along a diagonal D makes it possible, for a given size of cubic box, for the outer frame 34 of the gyroscopic system to be as large as possible along the major axis of the ellipse, on the one hand, and for a larger-sized receptacle to be used, on the other.

Thus, the outer frame has a large capacity for elastic deformation and therefore a great ability to protect the receptacle 16 from knocks.

The transport device according to the present invention applies more particularly to the transportation of biological products, such as gametes or embryos, which are kept at very low temperature using a cryogenic fluid such as liquid nitrogen for a determined length of time that is long enough to transport them.

The invention claimed is:

1. Device (10) for transporting a receptacle (16) comprising packaging (12) of polyhedral shape inside which there is arranged a gyroscopic system (14) intended to keep the receptacle (16) upright, of the type in which the gyroscopic system (14) comprises an inner first frame (32) which bears the receptacle (16) and an outer second frame (34), the inner first frame (32) being mounted so that it can rotate with respect to the outer second frame (34) about a first axis of articulation (A1) and the second frame (34) being mounted so that it can rotate with respect to the polyhedral packaging (12) about a second axis of articulation (A2) orthogonal to the first axis (A1), characterized in that the second axis of articulation (A2) extends more or less along one (D) of the diagonals of the polyhedral packaging (12).

2. Device (10) according to claim 1, characterized in that the outer second frame (34) is a flat ring and in that the second axis of articulation (A2) is situated in the plane of this ring.

3. Device according to claim 2, characterized in that the outer second frame (34) is a ring more or less in the shape of an ellipse and in that the second axis of articulation (A2) is more or less coincident with the major axis of the ellipse.

4. Device according to claim 3, characterized in that the first axis of articulation (A1) is more or less coincident with the minor axis of the ellipse.

5. Device according to claim 1, characterized in that the inner first frame (32) is a flat ring of circular shape and in that the first axis of articulation (A1) is situated in the plane of this circular ring.

6. Device according to claim 1, characterized in that it comprises supporting means (36, 64) supporting the gyroscopic system (14), on which the outer second frame (34) is mounted so that it can rotate about the said second axis of articulation (A2).

7. Device according to claim 6, characterized in that the supporting means (36, 64) comprise a flat supporting surround (36) comprising two opposed parallel mounting members (38) housed in two inside corners (30) of the polyhedral packaging (12) which corners are opposed along the said diagonal (D).

8. Device according to claim 7, characterized in that the supporting surround (36) comprises two parallel and opposed branches (40) which support articulation means (42) for articulating the outer second frame (34) with respect to the supporting surround (36) and which make an acute angle with respect to the said mounting members (38, 39).

9. Device according to claim 6, characterized in that the supporting means (36, 64) consist of two opposed components (64) each of which is arranged inside one of the said two vertices (28) of the polyhedral packaging (12) which are opposed along the said diagonal (D), and each of which supports articulating means (70) articulating the outer second frame (34) about the said second axis of articulation (A2).

10. Device according to claim 9, characterized in that each supporting intermediate component (64) comprises a base (66) which runs in a plane perpendicular to the said diagonal and supports, on the one hand, the articulating means (70) and, on the other hand, three positioning arms (68) arranged as a trihedron and each of which runs along one of the three edges associated with the said vertex (28) of the packaging.

11. Device according to claim 10, characterized in that the base (66) of the intermediate component (64) is of triangular shape and in that each positioning arm (68) runs from one (28) of the vertices of the triangular base.

12. Device according to claim 9, characterized in that the articulating means articulating the outer second frame (34) consist of a trunnion (70) secured to the outer second frame (34) and which is housed in a complementary housing (72) in the base (66) of the intermediate component (64).

13. Device according to claim 12, characterized in that the trunnion (70) of the outer second frame (34) is assembled with the base (66) of the intermediate component (64) as an elastic push-fit.

14. Device according to claim 6, characterized in that shock-absorbing means are inserted between the supporting means (36, 64) and the polyhedral packaging (12), particularly in the corresponding interior corners of the packaging.

15. Device according to claim 14 taken in combination with claim 10, characterized in that the shock-absorbing means is a cylindrical sleeve (74), made of an elastically deformable material, one end of which accommodates the positioning arm (68) and the other end (75) of which rests against an opposite face of the polyhedral packaging (12).

16. Device according to claim 1, characterized in that the receptacle (16) and the inner first frame (32) of the gyroscopic system (14) comprise complementary means so as to allow the receptacle to be introduced in an insertion travel perpendicular to the plane of the inner first frame (32), then allow the receptacle (16) to be locked in the inner first frame (32) at the end of the insertion travel.

17. Device according to claim 16, characterized in that the locking of the receptacle (16) in the inner first frame (32) is obtained, after insertion, by rotational movement so as to engage one or more cones (56) in complementary slots (62) in a bayonet-type mounting.

18. Device according to claim 16, characterized in that the locking of the receptacle (16) in the inner first frame (32) is obtained, after insertion, by elastic deformation of the inner first frame (32) so that the said inner frame (32) automatically positions itself in a complementary locking groove (78) belonging to the receptacle (16).

19. Device according to claim 1, characterized in that the transport receptacle (16) is a cryostat.

20. Device according to claim 1, characterized in that the polyhedral packaging (12) is a box of parallelepipedal, particularly cubic, shape, comprising an open upper face (20) for filling the box.

* * * * *